United States Patent [19]

Bauer et al.

[11] Patent Number: 4,991,412

[45] Date of Patent: Feb. 12, 1991

[54] OSCILLATORY SUPPORT FOR DRUM WASHING MACHINES

[75] Inventors: Fritz Bauer; Hans-Peter Bauer, both of Altdorf: Hans J. Bauer, Altdorf-Röthenbach, all of Fed. Rep. of Germany

[73] Assignee: Fritz Bauer & Shone oHG, Altdorf, Fed. Rep. of Germany

[21] Appl. No.: 539,594

[22] Filed: Oct. 6, 1983

[30] Foreign Application Priority Data

Oct. 12, 1982 [DE] Fed. Rep. of Germany ..... 3237759

[51] Int. Cl.[5] ..... D06F 37/22

[52] U.S. Cl. ..... 68/23.1; 68/24; 68/140; 210/144; 248/562; 248/638

[58] Field of Search ..... 68/23.1, 24, 140; 210/144, 148; 248/562, 636, 638, 623

[56] References Cited

U.S. PATENT DOCUMENTS

| | | | |
|---|---|---|---|
| 1,750,016 | 3/1930 | Meyer | 248/638 X |
| 2,711,297 | 6/1955 | Thiele | 248/638 X |
| 3,373,961 | 3/1968 | Long | 248/638 X |
| 3,509,742 | 5/1970 | Bauer | 68/23.1 |
| 3,703,091 | 11/1972 | Steele | 68/23.1 |
| 3,744,746 | 7/1973 | Weir et al. | 248/638 X |

FOREIGN PATENT DOCUMENTS

| | | | |
|---|---|---|---|
| 49311 | 8/1966 | Fed. Rep. of Germany | 68/23.1 |
| 1460884 | 2/1969 | Fed. Rep. of Germany | 68/23.1 |
| 2016539 | 4/1970 | Fed. Rep. of Germany | 68/23.1 |
| 2327340 | 5/1973 | Fed. Rep. of Germany | 68/23.1 |
| 1383101 | 11/1964 | France | 68/23.1 |
| 1123206 | 8/1968 | United Kingdom | 68/23.1 |
| 1426426 | 2/1976 | United Kingdom | 68/23.1 |
| 1520383 | 8/1978 | United Kingdom . | |
| 2078882 | 1/1980 | United Kingdom | 68/23.1 |
| 2061427 | 9/1980 | United Kingdom . | |

*Primary Examiner*—Frankie L. Stinson
*Attorney, Agent, or Firm*—Browdy and Neimark

[57] ABSTRACT

An oscillatory support for drum washing machines having a horizontal axis of rotation comprises a washer unit (1) supported on a base plate (4) via at least two spring struts (2) disposed at either side of the vertical plane passing through the axis of rotation. The spring struts (2) are elastically articulated at one end on the base plate (4) and on the other end are articulated with their respective tappets (13) on the washer unit (1). In order to provide support means which are simple in design and easily mounted and which have good oscillatory and damping properties, the spring struts (2) are articulated at both ends by means of a plug connection to the base plate (4) and the washer unit (1), respectively.

9 Claims, 2 Drawing Sheets

OSCILLATORY SUPPORT FOR DRUM WASHING MACHINES

FIELD OF THE INVENTION

The invention relates to an oscillatory support for drum washing machines having a horizontal axis of rotation, comprising a washer unit supported on a base plate via at least two telescopic spring struts disposed at either side of the vertical plane passing through the axis of rotation. On one end, the spring struts are articulated elastically on the base plate, and on the other they are articulated with their respective tappets on the washer unit.

BACKGROUND OF THE INVENTION

From U.S. Pat. No. 3,509,742, a resilient support is known, in which one resilient body each is disposed above and below the base plate spaced apart from the axis of the spring strut. Two resilient bodies in alignment with one another are fastened together with clamping bolts, and plates are attached to the clamping bolts at the top and bottom; the lower end of the spring strut is then screwed to the upper plate. This resilient support has proved highly satisfactory in principle.

From German laid-open application De-Os No. 20 16 539, an elastic support for drum washing machines having a horizontal axis of rotation is known, in which again a washer unit is supported on a base plate via a plurality of spring struts. Each spring strut is provided at the bottom with a recess in the form of a spherical segment, which is mounted onto a corresponding spherical element on the base plate. An elastic body comprising a rubber plate is disposed beneath the base plate, and a plate rests on the underside of this elastic body. The plate resting on the underside of the elastic body is fastened to the spring strut via a threaded bolt welded on the spring strut. This known support has the disadvantage that, first, it is very complicated and, second, the rubber part does not exert sufficient restoring force upon the spring strut in the event of tilting of the spring strut. The ball element and the spherical recess have the sole function of damping friction.

From British Pat. No. 1,520,383, an oscillatory support of the generic type discussed above is known, in which the upper end of the tappet of each spring strut, in the vertical plane located perpendicular to the axis of rotation, presses at either end against elastically yielding members but is rigidly supported in the vertical plane parallel to the axis of rotation. A given spring strut is supported at its lower end on the base plate by two rubber rings through which clamping elements pass. While the upper articulation of the spring strut is already very simple in design and easy to mount, as well as simultaneously having good shock-absorbing and damping properties, the lower articulation is complicated in design and difficult to mount.

SUMMARY OF THE INVENTION

It is accordingly an object of the present invention to create a support of the generic type discussed, which is simple in design and easy to mount and which has good oscillatory and damping properties.

In accordance with the invention, this object is attained by articulating the spring struts at both ends. Mounting is easily accomplished, because the spring strut can be connected with the base plate on one end and the washer unit on the other simply by being inserted; thst is, by means of a plug connection. No further manipulation is necessary. The design of these parts is correspondingly simple.

As a result of an embodiment wherein a given spring strut has a coaxially disposed tang at least on its lower end, the tang being inserted into a vibrator and damping element which is disposed on the base plate and supported on all sides, a damping, resilient plug connection is attained in a simpler manner between the spring strut and the base plate, as a result of which restoring forces do engage the foot of the spring strut, or in other words directly between the base plate and the spring strut.

According to a construction wherein the spring strut has a coaxially disposed tang on its upper end, which is inserted into a vibrator and damping element which is disposed on the washer unit and supported on all sides, it is particularly advantageous to provide a plug connection of the same type on the washer unit as well. This combination results in a very particularly elastic and damping articulation of a given spring strut on the base plate and on the washer unit.

A particularly simple receptacle for the vibrator and damping element is a support casing having the same cross section as the elements.

As a result of a construction wherein a given spring strut rests on its respective vibrator and damping element with a thrust bearing, the elasticity and damping properties of the vibrator and damping element are exploited not only upon deflections of the spring strut but also in the event of pressure forces, that is, when the spring strut telescopes inward, and in each case the exploitation is over the entire height of the total vibrator and damping element.

As a reslt of the features wherein a given vibrator and damping element has a recess passing all the way through it and receiving the respective tang, and the respective support casings each have an associated passageway opening, it is assured that on the one hand the tang of the given vibrator and damping element can pass through to its full length, and is thus guided and held in optimal fashion, and on the other hand compression of the vibrator and damping elements is still possible.

By means of the provisions wherein a given tang is disposed in its respective vibrator and damping element with a friction-tight press fit, and a given vibrator and damping element is fixed in the associated support casing in the direction of the central longitudinal axis of the spring strut, within a limited range, tensile forces also can be absorbed by the articulations, although the connections are solely of the plug connection type.

As a result of the construction wherein the vibrator and damping elements have a longer length in the direction perpendicular to the central longitudinal axis of the spring support and perpendicular to the axis of rotation than in the direction perpendicular to the central longitudinal axis and parallel to the axis of rotation, pitching and swaying oscillations are suppressed to the greatest possible extent, while oscillations caused by off-balance masses can develop freely—although in a damped manner—when passing through the critical speed range.

In an alternative to the articulation wherein the vibration and damping element is disposed on the washer unit, the spring strut has on its upper end a ball, which is resiliently locked into a recess having the form of a spherical segment in an abutment disposed on the washer unit. Here, only frictional forces are generated in the upper articulation, which is embodied again as a plug connection, and the frictional forces contribute to damping oscillatory movements.

Further advantages and characteristics of the invention will become apparent from the ensuing description of two exemplary embodiments, taken in conjunction with the drawings.

DESCRIPTION OF THE PREFERRED EMBODIMENTS

Figure 1:
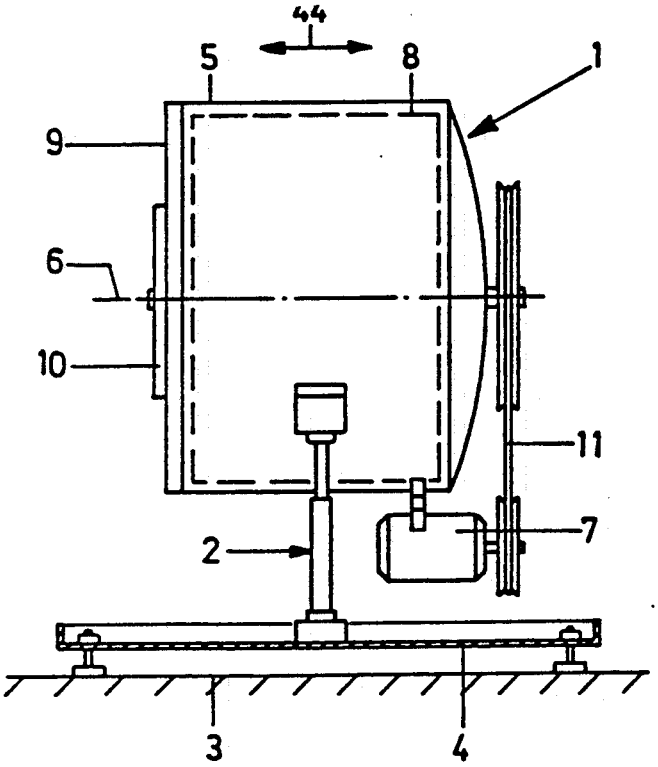
FIG. 1 is a schematic side view of a washing machine having support means according to the present invention.
Figure 2:
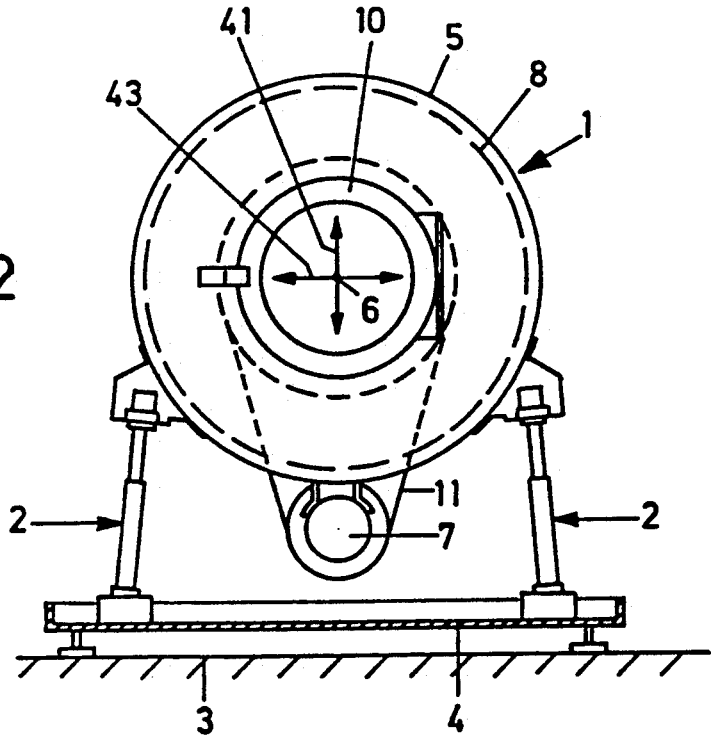
FIG. 2 shows the washing machine of FIG. 1 in a front view.

A drum washing machine has a washer unit 1, which is supported via telescopic spring struts 2 on a base frame or base plate 4 which stands on the floor 3.

The washer unit 1 has a washer housing 5, in which a washer drum 8, which is drivable about a horizontal axis of rotation 6 by a drive motor 7 flanged to the washer housing 5, is disposed. Putting laundry into and removing it from the washer drum 8 is accomplished through a door 10 disposed on one end face 9 of the washer housing 5. The drive is transmitted from the drive motor 7 to the washer drum 8 in the conventional manner, by means of a V-belt drive 11.

Each spring strut 2 has a cylindrical tube 12, in which a tappet 13 is displaceably guided coaxially. A guide piston 14 is embodied on the inner end of the tappet 13 and may be provided with annular recesses 15 in which friction elements 16 are disposed. The tappet 13 and the guide piston 14 are injection molded in one piece from plastic. The friction elements 16 may comprise foamed, closed-cell polyurethane.

A prestressed helical compression spring 18 is disposed between the guide piston 14 and the bottom 17 of the tube 12. The tube 12 is provided on its end toward where the tappet emerges with an indrawn edge 19 radially overlapping and gripping the guide piston 14, so that the tappet 13 cannot unintentionally be removed from the tube 12. The spring strut 2 shown is a so-called damped spring strut. If the friction elements 16 are not present, then it is an undamped spring strut. Both types of spring strut are generally known—to the extent that they have thus far been described herein—and are available in commerce (see German laid-open application DE-OS No. 25 34 650, corresponding to British Pat. No. 1,520,383).

The design and function of the tappet having guide pistons and friction elements are described in German laid-open application No. 29 42 716 (corresponding to British Pat. No. 2,061,427).

A flange-like thrust bearing 20 having the shape of an annular disk is disposed on the lower end of the tube 12, and a cylindrical tang 22 extends in turn, coaxially with the central longitudinal axis 21 of the spring strut 2, from this thrust bearing 20.

A thrust bearing 23 is likewise embodied on the upper face end of the tappet 13, and a corresponding tang 24 extends upward from this thrust bearing 23, coaxially with the longitudinal axis 21.

A support element 25 for each spring strut 2 is disposed on the base plate 4, substantially comprising a support casing 26 open at the top and correspondingly extending along the longitudinal axis 21. The support casing 26 has in its bottom a passageway opening 28 concentric with the longitudinal axis 21; the diameter of the opening 28 is in every case larger than that of the tang 22.

A support element 29 for each spring strut 2 is likewise disposed on the washer housing 5, having a support casing 30 disposed such that it is open at the bottom and embodied identically with the support casing 26. The bottom 31 of the support casing 30 is thus also provided with a passageway opening 32, the diameter of which is greater than the diameter of the tang 24.

Figure 4:
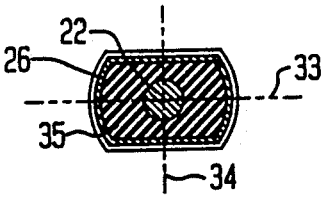
FIG. 4 is a section taken along the line IV—IV of FIG. 3.

As may be seen in FIG. 4, the support casings 26 and 30 have an approximately rectangular cross section, this cross section being formed—as in the present instance—by a circle which is formed by two secants that are parallel to one another and disposed symmetrically with respect to the center. A given (longer) primary axis 33 extends perpendicular to the longitudinal axis 21 and perpendicular to the axis of rotation 6 of the washer drum 8. The shorter, secondary axis 34 likewise extends perpendicular to the longitudinal axis 21 but is parallel to the axis of rotation 6.

Vibrator and damping elements 35, 36 of rubber are disposed in the support casings 26 and 30, their cross sections corresponding to that of the support casings, and they each protrude by a section a in the direction of the longitudinal axis 21 beyond the respective edges 37, 38 of the support casings 26, 30. Each element 35, 36 has a cylindrical recess 39, 40 adapted to the respective tang 22, 24, which is fitted into this recess 39, 40 with a friction-tight press fit. Thus in the relaxed state, the diameter of the recess 39, 40 is slightly smaller than the diameter of the tangs 22, 24. The tangs 22 and 24 pass through the elements 35 and 36 to approximately their full length.

The elements 35, 36 are likewise seated in the respective support casings 26, 30 with a friction-tight press fit.

When the washer drum is increasing speed from a washing speed, which is below the critical level, to a spinning speed, beyond the critical level, severe off balance forces arise in the washer drum 8 upon passing through the critical speed, causing marked oscillation of the washer unit 1. Oscillation components acting in the vertical direction indicated by the arrow 41 predominantly cause movements of the tappet 13 relative to the cylindrical tube 12 and are—if they are exerted downward—absorbed resiliently by the corresponding compression spring 18 and also—in both vertical directions—are damped by the friction of the friction elements 16 against the inner wall 42 of the tube 12. If the friction elements 16 are not present, then a separate damper is regularly articulated between the base plate 4 and the washer housing 5, which is likewise generally conventional and well known.

Figure 3:
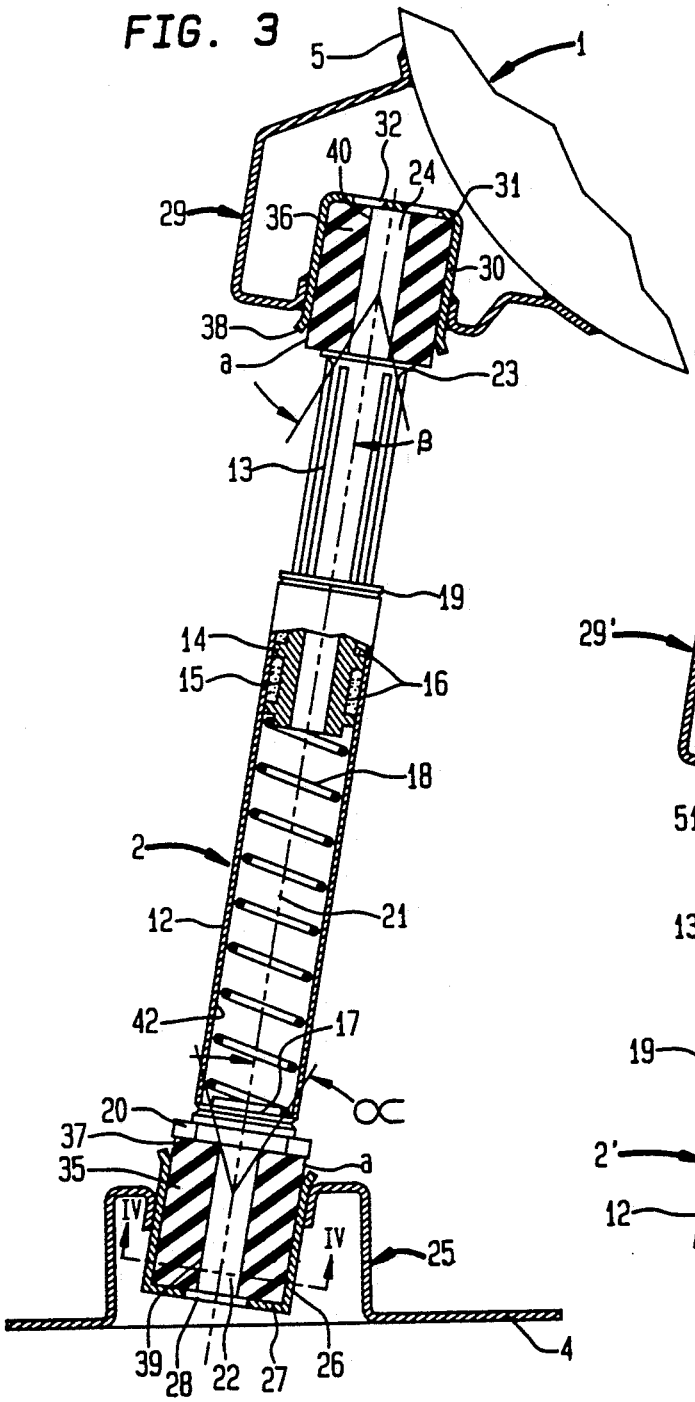
FIG. 3 is an enlarged detail of FIG. 2 showing one spring strut and its articulation in a partly cutaway view.

Horizontal oscillation components acting in the horizontal direction represented by the arrow 43 and thus at right angles to the axis of rotation 6 cause deflections of the spring strut 2, in fact, as shown in FIG. 3, deflections of the central longitudinal axis 21 by an angle of $\alpha$ or $\beta$, which are shown highly exaggerated in the drawing. In practice, these angles amount to 5° at the most. Since a given spring strut 2, during the horizontal oscillations indicated by the arrow 43, oscillates in the direction of the longer primary axis 33, where more elastic material is available, the spring strut is capable of deflecting outward relatively far at the top and bottom. During these oscillations, a portion of the oscillatory energy is damped by the internal friction in the vibrator and damping elements 35, 36, while a portion of it is converted into elastic restoring forces. The washer unit 1 can thus oscillate relatively far outward in both the vertical direction represented by the arrow 41 and the horizontal direction, perpendicular to the axis of rotation 6, indicated by the arrow 43. The vibrator and damping elements 35, 36 also serve as shock-absorbing elements and as damping elements in terms of the vertical oscillation. It is impossible for the tangs 22 or 24 to slip out of the associated elements 35 or 36 because of the friction-tight press fit already mentioned, especially since the spring struts 2 are in any case dimensioned such that the guide piston 14 will not be struck on the edge 19 even under the most extreme operating conditions.

If the washer unit 1 is executing tilting oscillations in the direction of the axis of rotation 6 as indicated by the arrow 44, deflections of the spring strut about its longitudinal axis 21 are possible only within a very limited range, because in these oscillations relatively little elastic damping material is available, in the direction of the secondary axis 34 of the elements 35 and 36, between the respective tang 22 or 24 and the support casing 26 or 30. The articulation of the spring struts 2 in this direction is accordingly rigidly elastic.

Figure 5:
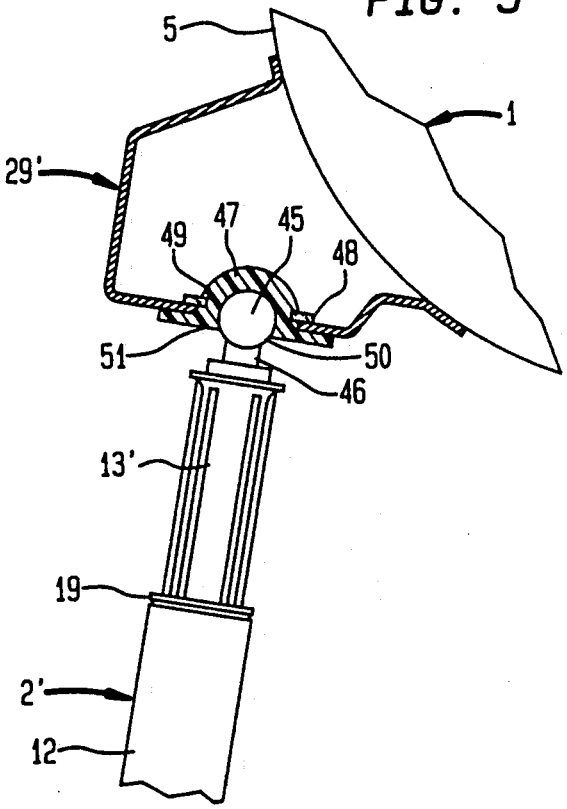
FIG. 5 shows a modified realization of the upper articulation of a spring strut.

The form of embodiment according to FIG. 5 differs only in that the spring strut 2' is articulated at its upper end not elastically but in a damping manner, on the support element 29' of the washer housing 5. The tappet 13' of the spring strut 2, to this end, has a ball 45 instead of the tang 24, and the ball 45 is connected with the tappet 13' via an intermediate tang 46. An abutment 47 is fixed on the support element 29' by means of a securing ring 48. This abutment 47 has a recess 49 in the form of a spherical segment, the inside circumference of which extends over more than 180°, preferably over from 220° to 240°. The inside diameter of this recess corresponds approximately to the diameter of the ball 45. On one side, this recess 49 has an oblique insertion surface 51 toward its lower opening 50, so that—since the abutment 47 is made of elastically deformable plastic—the ball 45 can be locked into place by being passed through the opening 50 into the abutment 47, the opening 50 widening elastically during the process. Suitable plastics having a sufficiently high coefficient of friction with the metal, in particular steel, of which the ball 45 is made, include polyamides, which are available in commerce.

In this embodiment, the function is fundamentally the same as in the embodiment having the spring strut according to FIGS. 3 and 4. The difference is that no restoring forces occur in the upper articulation; instead, only forces which damp oscillations in the horizontal direction indicated by the arrows 43 and 44 occur.

In both embodiments, the connection is of a purely plug-type nature, in which either the tangs 22 and 24 are pushed into the recesses 39 and 40, respectively, or the ball 45 is inserted into the recess 49.

As may be seen in FIG. 3, the vibrator and damping elements 35, 36 are embodied as relatively long. The structure shown thus enables particularly good oscillation and damping, even in the direction of the central longitudinal axis 21.

It is to be understood that the invention is not limited to the embodiments disclosed which are illustratively offered and that modifications may be made without departing from the invention.

What is claimed is:

1. An oscillatory support for drum washing machines having a horizontal axis of rotation, including a washer unit supported on a base plate via at least two telescopic spring struts disposed at either side of a vertical plane passing through the axis of rotation, each spring strut having one end articulated elastically on the base plate and an opposite end articulated on the washer unit via a tappet, said support comprising:

a plug connection for articulating each end of said spring struts on the base plate and the washer unit, respectively, the plug connection including a tang coaxially disposed on each of the upper and lower ends of each spring strut, a vibration and damping element formed of an elastic material disposed in a support casing on each of said base plate and said washer unit, each said vibration and damping element having the same cross-section as said support casings and being supported on its bottom and sides by its respective casing and with its upper end facing the spring strut, each lower end tang being disposed in a respective vibration and damping element supported on said base plate with a friction-tight press fit, and each upper end tang being disposed in a respective vibration and damping element supported on said washer unit with a friction-tight press fit, means for compressing said vibration and damping element as said spring strut elongates, including a thrust bearing, each spring strut resting on the upper end of its respective vibration and damping element with said thrust bearing, and each vibration and damping element being fixed in its respective support casing in the direction of the central longitudinal axis of the spring strut.

2. A support as defined by claim 1, wherein each vibration and damping element has a recess passing all the way through it and receiving the respective tang, and the respective support casings each have an associated passageway opening.

3. A support as defined by claim 1, wherein the vibration and damping elements (35, 36) have a longer length (primary axis 33) in the direction (43) perpendicular to the central longitudinal axis (21) of the spring support (2) and perpendicular to the axis of rotation (6) than in the direction (44) perpendicular to the central longitudinal axis (21) and parallel to the axis of rotation (6) (secondary axis 34), said vibration and damping elements being of unitary construction.

4. A support as defined by claim 1, wherein a given vibration and damping element (35 or 36) is disposed in a support casing (26 or 30) having the same cross section.

5. A support as defined by claim 1, wherein a given spring strut (2) rests on its respective vibration and damping element (35, 36) with a thrust bearing (20, 23).

6. A support as defined by claim 5, characterized in that a given vibration and damping element (35, 36) is disposed in a support casing (26, 30) having the same cross-section, and has a recess (39, 40) passing all the way through it and receiving the respective tang (22, 24), and the respective support casings (26, 30) each have an associated passageway opening (28, 32).

7. An oscillatory support for drum washing machines having a horizontal axis of rotation, including a washer unit supported on a base plate via at least two telescopic spring struts disposed at either side of a vertical plane passing through the axis of rotation, each spring strut including a longitudinal axis and having one end articulated elastically on the base plate and an opposite end articulated on the washer unit via a tappet, said support comprising:

a plug connection for articulating each end of each said spring strut on the base plate and the washer unit, respectively, the plug connection including a tang coaxially disposed on each of the upper and lower ends of each spring strut, a unitary vibration and damping element disposed in a support casing on each of said base plate and said washer unit, each said vibration and damping element having the same cross-section as said support casings and including a coaxial bore, said vibration and damping elements each being supported on its bottom and sides by its respective casing, each lower end tang being disposed in the bore of a respective vibration and damping element supported on said base plate, and each upper end tang being disposed in the bore of a respective vibration and damping element supported on said washer unit, each spring strut resting on its respective vibration and damping element with a thrust bearing, and each vibration and damping element being fixed in its respective support casing in the direction of the longitudinal axis of the spring strut, whereby axial support for each spring strut is provided substantially solely by said thrust bearings while support for said spring strut is directions normal to said strut longitudinal axis is provided solely by the interaction of said upper and lower end tangs with their respective vibration and damping element.

8. A support as defined by claim 7, wherein a given tang (22, 24) is disposed in its respective vibration and damping element (35, 36) with a friction-tight press fit, and that a given vibration and damping element (35, 36) is fixed in the associated support casing in the direction of the central longitudinal axis (21) of the spring strut (2).

9. A support as defined by claim 7, wherein the vibration and damping elements (35, 36) have a longer length (primary axis 33) in the direction (43) perpendicular to the central longitudinal axis (21) of the spring support (2) and the perpendicular to the axis of rotation (6) than in the direction (44) perpendicular to the central longitudinal axis (21), and parallel to the axis of rotation (6) (secondary axis 34), said vibration and damping elements being of unitary construction.

* * * * *